United States Patent [19]

Hoopes

[11] 4,086,743

[45] May 2, 1978

[54] TENNIS BALL REVITALIZER

[76] Inventor: Dallett Hoopes, 99 Mill, Waterbury, Conn. 06720

[21] Appl. No.: 740,482

[22] Filed: Nov. 10, 1976

Related U.S. Application Data

[63] Continuation of Ser. No. 565,831, Apr. 7, 1975, abandoned.

[51] Int. Cl.[2] ..... B65B 31/08

[52] U.S. Cl. ..... 53/79; 141/329; 273/61 D

[58] Field of Search ..... 53/7, 79; 128/173 H, 128/184; 141/19, 38, 46, 113, 114, 37, 267, 276, 329, 330, 351-355, 369, 294; 152/370, 415; 156/145; 206/315; 273/61 D; 222/402.1, 402.13, 402.16

[56] References Cited

U.S. PATENT DOCUMENTS

| | | | |
|---|---|---|---|
| 3,841,532 | 10/1974 | Gores | 222/402.13 |
| 3,929,174 | 12/1975 | Isnardi | 141/329 |

*Primary Examiner*—Richard E. Aegerter
*Assistant Examiner*—Frederick R. Schmidt
*Attorney, Agent, or Firm*—Dallett Hoopes

[57] ABSTRACT

A simple, easily-operated device is provided by which a "dead" tennis ball can be revitalized by injecting it with a gas, preferably in the form of an aerosol propellant. The device described comprises an aerosol container suitably charged and connected to a tubular needle and also a ball-receiving cup. Pressure from the propellant restores original bouncing quality to the ball. A sealant can be mixed with the propellant or gas if desired or necessary. Proper selection of propellant and sealant mixture automatically meters the amount of sealant moving into the ball. Safety features of the device protect the needle.

10 Claims, 4 Drawing Figures

TENNIS BALL REVITALIZER

This is a continuation of application Ser. No. 565,831, filed Apr. 7, 1975 now abandoned.

BACKGROUND OF THE INVENTION

1. Field of the Invention

This invention relates to apparatus for revitalizing tennis balls. More specifically, this invention relates to means for increasing the pressure inside a tennis ball for the purpose of restoring bounce quality to a used tennis ball similar to the bounce quality it had when new.

2. Description of the Prior Art

In the manufacture of tennis balls, the inside of the rubber shell of the ball is often pressurized with fluid pressure in the range of 10 to 12 pounds per square inch. This pressure contributes substantially to the bounce of the ball over and above the natural resilience of the rubber of the ball. To assure that tennis balls arrive at the marketplace still with the desired fluid pressure, balls are packaged in a metal can under pressure approximating the pressure within the ball so that there is an equilibrium across the ball shell. There is thus little or no tendency for pressure within the ball to escape through the pores of the ball as long as the ball is in its package. After the opening of its pressurized can, the ball is only under atmospheric pressure and soon loses its internal pressure. One explanation for this loss is that as the ball ages, it expands slightly and pores in the rubber open up thus permitting internal pressure to leak out. Losing its pressure, the ball correspondingly looses its original bouncing quality and becomes a "dead" ball.

Attempts have been made to provide devices to help maintain a tennis ball at its original bouncing quality. Such devices include pressureable containers simulating the original pressurized can and into which the balls are put after play and during storage. Also, clamps have been offered comprising hemispheres closed tightly about the ball to inhibit its expansion during storage on the theory that inhibiting expansion will delay development of leaking pores in the rubber shell of the ball.

Prior attempts to prolong the life of tennis balls have been troublesome and have generally not been effective. They have not offered the possibility of immediately revitalizing a "dead" ball.

SUMMARY OF THE INVENTION

The invention comprises an apparatus affording means for injecting fluid under pressure into a tennis ball. The apparatus comprises a fluid-containing pressurized container having an upwardly extending stem means coupled to a tubular needle. A ball-receiving holder surrounds the upper end of the needle and is supported on the container by spring means. Simple depression of the ball in the holder causes the needle to pierce the ball including its rubber shell and turns on the valve injection fluid into the ball.

DESCRIPTION OF THE PREFERRED EMBODIMENT

Figure 1:
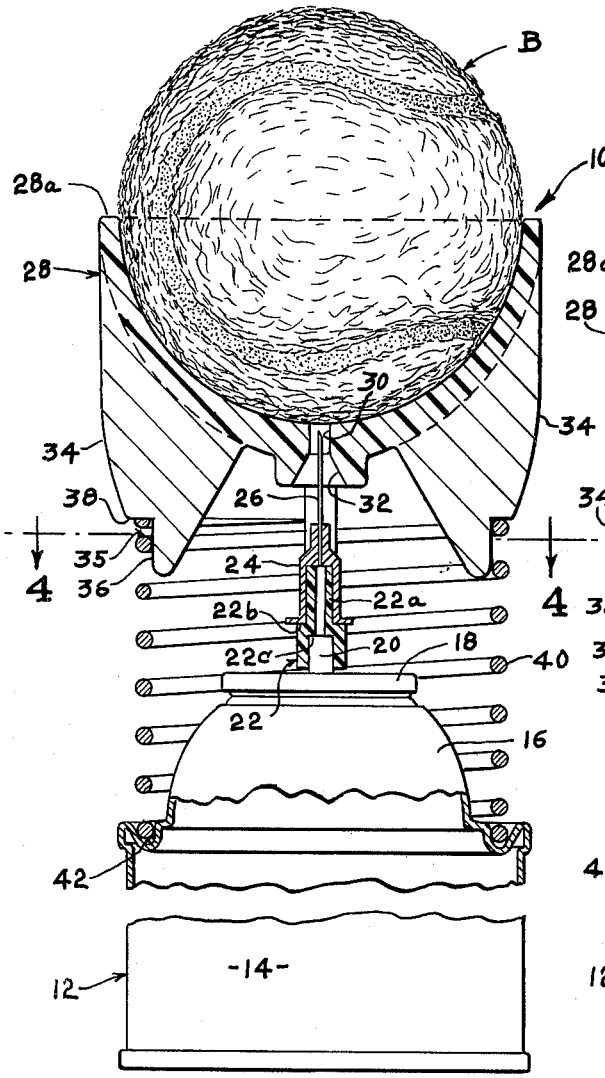
FIG. 1 is a view partly in section of an apparatus embodying the invention with the aerosol container shown in broken and abbreviated form.

An apparatus embodying the invention is shown in FIG. 1 and generally designated 10. It comprises an aerosol container 12, including a cylindrical can 14 having a dome-like top 16 onto which is mounted a valve mounting cup 18. The valve (not shown) presents an upstanding conventional tubular stem 20. In use, the depression of such a stem 20 actuates the valve so that fluid within the container 14 is discharged through the valve. The valve is provided with a dip tube (not shown) within the container 14 to elevate material under pressure up the tube to the valve.

Disposed in tight press fit on the stem 20 is a cylindrical tubular spud 22. The spud or adaptor, which may be plastic, has a reduced diameter portion **22*a* defining adjacent the mid-section of the portion an external radial shoulder 22*b*. Inside the spud, advancing upward the inner diameter reduces adjacent its mid-section to provide an internal shoulder 22*c*. In assembly, the upper end of the stem 20 butts against the shoulder 22*c***.

Pressed onto the reduced diameter **22*a* of the spud is the needle mounting base 24 which at its lower end engages against the shoulder 22*b*. The upper end of the mounting secures the tubular needle 26** in the conventional sealed manner. The upper end of the needle, as is conventional, is bevelled off at an angle to provide a sharp point.

The needle is preferably of the medical type and of a diameter not greater than 0.020 inch. While needles of this type may be found in varying diameters and lengths, an effective one has been found to be about $\frac{5}{8}$ inch long and is designated 25 gauge.

The stem 20, the tubular spud or adapter 22, base 24, and the needle 26 may be referred to as tubular means. Through the center of the bottom of the holder 28 there is a circular opening 30 which receives the needle 26. At its lower end, the opening 30 flares outward as at 32 partly to assist in the guiding of the needle into the opening 30 in assembly.

Figure 3:
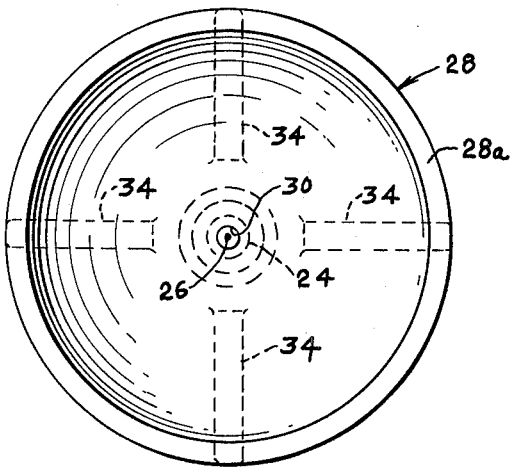
FIG. 3 is a top plan view without the tennis ball of the apparatus shown in FIG. 1.
Figure 4:
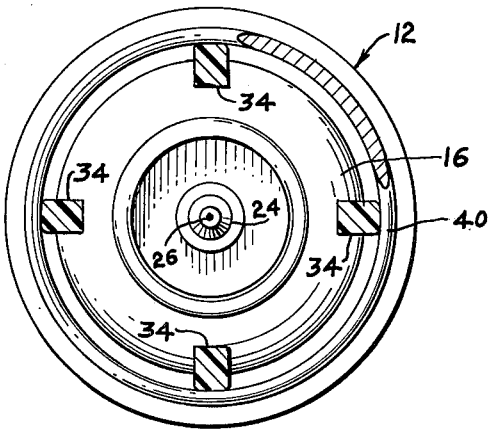
FIG. 4 is a sectional view taken on the line 4-4 of FIG. 1.

Radial webs 34 are provided uniformly about the underside of the holder or cup 28. These webs are formed integrally with the cup in a single molding operation. The webs, as shown in FIG. 3, are of considerable width and at their lower end are formed with outwardly facing notches 35 which comprise the substantially vertical surfaces 36 and the horizontal surfaces 38.

A spiral metal compression spring is provided and is designated 40. This spring has its lower end preferably wedged in the annular trough 42 formed about the lower end of the dome 16 in a retaining press fit. The fit is peferably such that while the lower end of the spring may be pried out of the trough 42, as for the replacement of the aerosol container 12, the spring is normally held assembled with the aerosol container by its tight fit.

The upper end of the spring 40 surrounds and inwardly compresses against the webs 34 respectively in the notches 35 described above, the upper end of the spring abutting against the horizontal surface 38 in each notch and the inner surface of the spring snugly engaging the webs at the vertical surfaces 36. This snug engagement is sufficient to hold the spring and holder 29 together in use.

Figure 2:
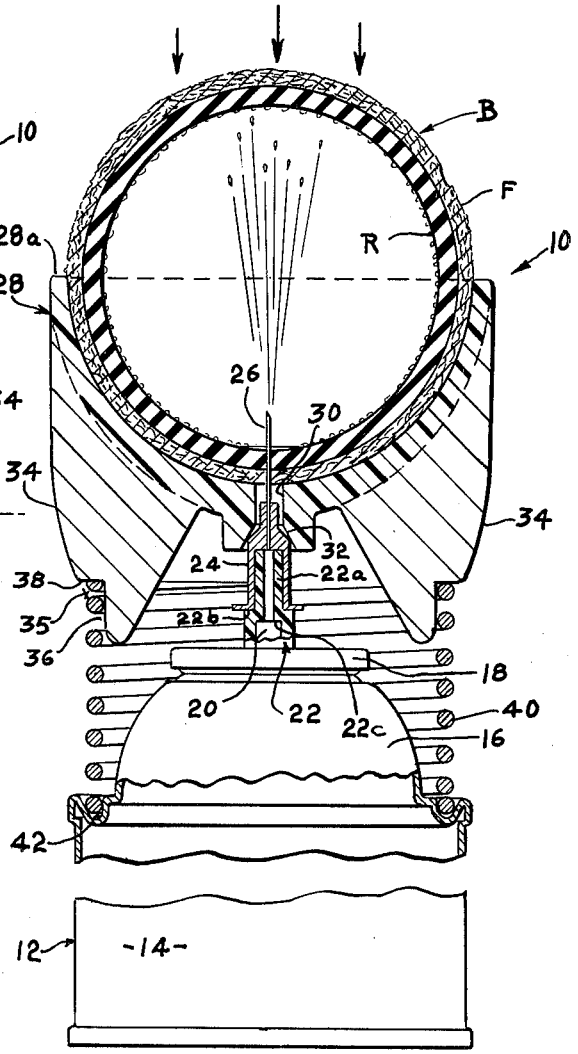
FIG. 2 is similar to FIG. 1 but with the ball in section and showing the apparatus during injection.

In operation, the ball to be treated is inserted into the cup 28, as shown in FIG. 1. The ball is then simply pressed down (see arows, FIG. 2) causing the upper end of the needle 26 to pierce the ball fabric covering F and the rubber shell R of the ball (FIG. 2). Further downward movement of the ball causes the cup at flaring portion 32 of the opening 30 to engage the needle mounting 24. Still further downward movement causes the valve at the lower end of the stem 20 to open. The depression of the ball is actually done in a single simple continuous stroke, but has been described as a stepped procedure herein to facilitate understanding.

Upon the opening of the valve, the fluid inside the aerosol container 14 moves up through the stem 20 through the needle 26, and into the ball. The liquid propellant boils off, creating pressure. The filling is accompanied by an audible hissing sound, and the amount of fluid which passes into the ball is limited by the development of an equilibrium between the pressure in the container and pressure in the ball.

At the end of the operation, the ball is released, permitting the spring 40 to lift the holder and ball upwardly so that the needle is withdrawn from the ball. Because the needle hole is at the bottom of the ball, if there is slight leakage through the hole made by the needle, droplets of liquid—if a sealant is used—having fallen to that lower point, will tend to move out the hole and will cause an effective sealing of the ball thereafter. Thus, keeping the ball in the position shown in FIG. 1 for at least three seconds after the operation helps in the sealing process.

Significant safety features of the invention are the protection of the pointed needle from an exposed disposition. As is shown in FIG. 1, the extremely sharp end of the needle is not exposed into the cup when the unit is not in use: the upper end of the needle is slightly lower than the upper end of the opening 30. Also, the needle is shorter than the walls of the cup so that should the holder 28 be depressed without a ball in it, the upper end of the needle is well below the rim 28*a* of the cup. Obviously, this structure avoids the possibility of the sharp needle contacting people or things. These are desirable and significant feature of the invention. The safety feature of the apparatus make it appropriate for a household item.

With regard to the fluid in container 14, it has been observed that to a considerable extent some tennis balls are self-sealing so that as a consequence the apparatus is effective with a simple propellant or liquified gas, such as a Freon, or fluorocarbon, in container 14. In such cases, to accurately control pressure in the ball, a container such as 14, but without a dip tube, may be used so that the gas pressure of the propellant communicates in gaseous form only through the needle into the ball. Preferably in all cases, the propellant has a vapor pressure of at least about 10 psig at 70° F. Freon 114, a fluorocarbon having a vapor pressure of about 14 psig at 70° F., has been used.

In some instances, a sealant is helpful in the fluid going into the ball. Appropriate propellants or other gases and sealants will be apparent to those skilled in the chemical/aerosol arts. When a sealant is used with a propellant, if the fluid is properly formulated, the amount which goes into the ball will be automatically metered and a desired pressure and amount of sealant fluid will be in the ball at the end of the operation. By "sealant" herein and in the claims is meant a substance which, disposed on the inner surface of the ball or in the shell, tends to block the escape of fluid from the inside of the ball. This "sealant" may remain in small quantity in liquid state inside the ball without noticeably affecting the behavior of the ball. Examples of sealants range from latex with fibers to polyvinylpyrrolidone and copolymers thereof.

Just as the fluid used with the invention can be varied, so the structure of the apparatus described can be changed. For instance, the spring 40 may be readily replaced by a plastic spring, perhaps molded integrally with the holder 28. The aerosol valve used may be of the "female" variety as is often provided in the art with paint aerosols so that the adapter 22 may extend directly down into the valve.

It should be clear, therefore, that the invention is susceptible of many variations, all falling within the scope of the following claim language:

I claim:

1. Apparatus for revitalizing a tennis ball comprising:

a. a container of fluid under pressure and having an upstanding tubular discharge stem means with a valve at its lower end operable by depressing the stem means;

b. a tubular needle operatively connected to the stem means and extending upward above the upper end thereof;

c. a tennis-ball-receiving cup above the container having an opening at the center of the bottom thereof the opening being vertically aligned with the needle;

d. resilient means disposed about the needle and resting on the container and engaging and supporting the cup normally at a level above the top of the needle and permitting some downward movement of the cup independent of the needle so that the needle may be received through the opening and penetrate the ball; and e. an engaging surface associated with the cup adapted as the cup and ball are moved down to depress the stem means, opening said valve when the cup is down and the needle extends up into the ball whereby fluid from the container moves through the needle into the ball to increase the pressure therein.

2. Apparatus as claimed in claim 1 wherein the fluid includes an aerosol propellant and a sealant.

3. Apparatus as claimed in claim 1 wherein the fluid includes a propellant having a vapor pressure at 70° F. of no less than 10 psig whereby the fluid may be communicated with the ball to bring the ball to a pressure equal to said pressure which is the desired ball pressure.

4. Apparatus as claimed in claim 1 wherein when the cup is depressed to its limit, the rim of the cup is higher than the upper end of the needle.

5. Apparatus as claimed in claim 1 wherein the needle is formed with a mounting base adapted to be engaged by the said engaging surface to depress th stem means.

6. Apparatus for revitalizing a tennis ball comprising:

a. an aerosol container charged with aerosol propellant and a sealant and having discharge valve means at its upper end;

b. tubular means terminating in an upwardly extending needle connected to the valve means and extending upward therefrom, the valve means being openable upon depression of the tubular means;

c. a tennis-ball-receiving receptacle above the container and having a hole in the bottom thereof permitting passage of the needle through said bottom and into the ball;

d. spring means normally supporting the receptacle at a level above the needle; and e. the receptacle having means associated therewith for engaging and depressing said tubular means to open said valve means when the receptacle and ball are moved down against the face of the spring and the needle extends through the hole and into the ball whereby fluid from the container moves through the needle into the ball to increase the pressure therein.

7. Apparatus for revitalizing a tennis ball as claimed in claim 6 wherein the needle is no greater in outer diameter than 0.020 inch.

8. Apparatus as claimed in claim 6 wherein when the receptacle is depressed to its limit, the upper end of the receptacle is higher than the upper end of the needle.

9. A device for improving the bounce of a tennis ball by upgrading the pressure in the ball comprising;

a. an aerosol container charged with aerosol propellant selected as able to generate at least the desired internal pressure for the ball and a sealant and having discharge valve means at its upper end;

b. tubular means terminating in an upwardly extending needle connected to the valve means and extending upward therefrom said valve means being openable upon depression of the tubular means;

c. a tennis-ball-receiving cup disposed above the container and having a hole at the center of the bottom thereof permitting passage of the needle through said bottom and into the ball, the rim of the cup being higher than the upper end of the needle at all times;

d. spring means adjacent the container and circumposing the tubular means and normally supporting the cup at a level above the needle; and e. the cup having means for depressing said tubular means to open said valve means when the cup and ball are moved down and the needle extends up into the ball whereby fluid from the container moves through the needle into the ball to increase the pressure therein.

10. Apparatus as claimed in claim 9 wherein the spring means rests on the container.

* * * * *